US010172444B2

(12) United States Patent
Mouneimne

(10) Patent No.: US 10,172,444 B2
(45) Date of Patent: Jan. 8, 2019

(54) MULTIFUNCTIONAL MISWAK DEVICE

(71) Applicant: Mohamad Mouneimne, Katy, TX (US)

(72) Inventor: Mohamad Mouneimne, Katy, TX (US)

( * ) Notice: Subject to any disclaimer, the term of this patent is extended or adjusted under 35 U.S.C. 154(b) by 0 days.

(21) Appl. No.: 15/474,704

(22) Filed: Mar. 30, 2017

(65) Prior Publication Data

US 2017/0280866 A1 Oct. 5, 2017

Related U.S. Application Data

(60) Provisional application No. 62/315,245, filed on Mar. 30, 2016.

(51) Int. Cl.

| | |
|---|---|
| ***A46B 15/00*** | (2006.01) |
| ***B65D 43/16*** | (2006.01) |
| ***B65D 25/10*** | (2006.01) |
| ***B65D 51/24*** | (2006.01) |
| ***B65D 25/04*** | (2006.01) |
| ***A46D 1/00*** | (2006.01) |
| ***A46D 1/05*** | (2006.01) |
| ***A46D 3/00*** | (2006.01) |

(52) U.S. Cl.

CPC ..... *A46B 15/0091* (2013.01); *A46D 1/0215* (2013.01); *A46D 1/05* (2013.01); *A46D 3/00* (2013.01); *B65D 25/04* (2013.01); *B65D 25/10* (2013.01); *B65D 43/163* (2013.01); *B65D 51/24* (2013.01); *A46B 2200/1066* (2013.01)

(58) Field of Classification Search

CPC ..... A46B 5/00; A46B 5/0041; A46B 5/005; A46B 15/00; A46B 15/0091; A46B 2200/1066; A46D 1/00; A46D 1/02; A46D 1/0215; A46D 1/05; A46D 3/00; A61C 17/00; B65D 25/04; B65D 25/10; B65D 43/16; B65D 43/163; B65D 51/24; B65D 85/24

USPC ..... 206/38, 38.1, 63.3, 368, 369, 380–383

See application file for complete search history.

(56) References Cited

U.S. PATENT DOCUMENTS

| | | | | |
|---|---|---|---|---|
| 1,385,288 | A * | 7/1921 | Walker | A61C 15/02 132/328 |
| D172,726 | S * | 7/1954 | Polk | 206/38 |
| 4,940,136 | A * | 7/1990 | Miller | A45D 29/02 132/75 |
| 6,076,658 | A * | 6/2000 | Nicholson | A44B 15/005 206/38.1 |
| 8,141,195 | B2 * | 3/2012 | Al-Sulaiman | A46B 5/0033 15/167.1 |
| 8,973,754 | B2 * | 3/2015 | Ahmed | A46B 5/0041 132/321 |

* cited by examiner

*Primary Examiner* — Bryon Gehman

(74) *Attorney, Agent, or Firm* — Benjamin Aaron Adler

(57) ABSTRACT

Provided are multifunctional cases, device and kits for storing, peeling and cutting a miswak twig. Generally, the multifunctional case comprises a case portion and a cap portion each of which may have one or more compartments therein. The case is configured to store one or more miswak twigs therein and to contain an optionally removable clipper for cutting the twigs. The cap portion contains an optionally removable peeler and may further comprise a storage compartment and/or a cluster of bristling picks. The case may also comprise a mechanism to advance and to retract a miswak twig. The kits provided comprise any of the multifunctional cases or devices described herein and one or more miswak twigs stored within the case or device.

22 Claims, 9 Drawing Sheets

MULTIFUNCTIONAL MISWAK DEVICE

CROSS-REFERENCE TO RELATED APPLICATIONS

This non-provisional application claims benefit of priority under 35 U.S.C. § 119(e) of provisional application U.S. Ser. No. 62/315,245, filed Mar. 30, 2017, the entirety of which is hereby incorporated by reference.

BACKGROUND OF THE INVENTION

Field of the Invention

The present invention generally relates to the field of personal care products. More specifically, the present invention relates to a multifunctional clipper and peeler kit for clipping, peeling and storing miswak.

Description of the Related Art

Miswak, made from the *Salvadora persica* tree, has been used as a traditional and natural alternative to the modern toothbrush for many centuries. Many researchers consider miswak to be superior to traditional toothbrushes for reductions in plaque and gingival indices. Although historically, miswak is predominantly used in Muslim cultures, it has been gradually gaining popularity with others.

However, miswak hygiene must be carefully maintained when it's used on a daily basis. Additionally, a device to conveniently peel the miswak and to cut the used bristles is essential to promoting the miswak as an everyday oral care product. Currently, there are very few cases for storing, clipping and peeling the miswak.

In one example, the case includes a double blade with a central opening to both cut and peel the miswak. These actions rely solely on the pressure applied on both ends by a user's hand, resulting in difficulty in conveniently aligning, cutting or peeling the miswak. The user must exert a relatively high amount of pressure to cut the miswak bristles, or attempt to apply a measured minimum amount of pressure to peel the miswak. This increases the time required to peel and to cut the miswak twig to the user's liking as well as increasing the chance for injury and wasted miswak material due to improper peeling. Additionally, cutting and peeling the miswak twig results in waste that needs to be properly disposed. Moreover, the existing cases are generally over 7 inches long to accommodate a relatively long section of the miswak twig. However, this length significantly reduces its portability especially when a user tries to carry it in his pocket.

Therefore, there is a recognized need in the art for a multifunctional kit for storing the miswak. Particularly, the prior art is deficient in a kit which can conveniently fit into and be secured in a pocket, and also allows users to conveniently align, peel and cut the miswak in a more convenient and controlled manner. The present invention fulfills this long-standing need and desire in the art.

SUMMARY OF THE INVENTION

The present invention is directed to a multifunctional case for storing, cutting and peeling miswak. The multifunctional case comprises a case portion and a cap portion in a removable covering relation with the case portion. In a related invention the multifunctional case further comprises means for connecting the cap portion to the case portion. In another related invention, the multifunctional case further comprises means for advancing and retracting a miswak twig contained in the case portion. In yet another related invention, the multifunctional case further comprises a clipper disposed in the case portion. In another related invention, the multifunctional case further comprises a peeler disposed in the cap portion. In yet another related invention, the multifunctional case further comprises a cluster of bristling picks affixed to an interior surface of the cap portion, where the bristling picks each comprises a base end affixed to the interior surface and a tapered, pointed end depending downwardly, equidistantly therefrom.

The present invention also is directed to a device for storing, cutting and peeling miswak. The device comprises a case with a first compartment and a second compartment and a cap with a forward compartment and a back compartment and having means for connecting to the case where the cap removably covers the case. A clipper is removably secured within the second compartment of the case and a peeler is removably secured within the back compartment of the cap. In a related invention the device further comprises a twist-up mechanism or a slide mechanism disposed on the case and configured for advancing and retracting a miswak twig disposed within the first compartment thereof.

The present invention is directed further to a kit for storing, cutting and peeling a miswak twig. The kit comprises the multifunctional case as described herein and one or more miswak twigs stored within the multifunctional case.

BRIEF DESCRIPTION OF THE DRAWINGS

So that the matter in which the above-recited features, advantages and objects of the invention, as well as others that will become clear, are attained and can be understood in detail, more particular descriptions of the invention briefly summarized above may be by reference to certain embodiments thereof that are illustrated in the appended drawings. These drawings form a part of the specification. It is to be noted, however, that the appended drawings illustrate preferred embodiments of the invention and therefore are not to be considered limiting in their scope.

DETAILED DESCRIPTION OF THE INVENTION

Figure 1A:
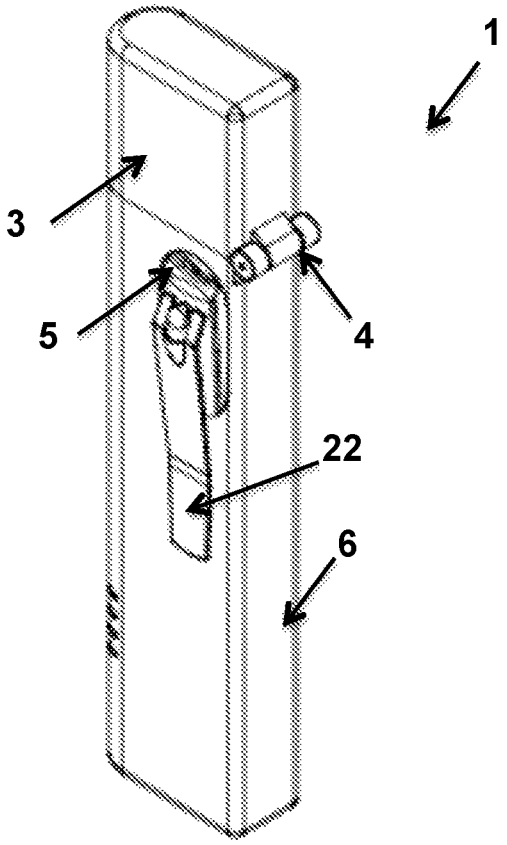
FIGS. 1A-1B are perspective views of the back and side (FIG. 1A) and the front and side (FIG. 1B) of the miswak device.

As used herein in the specification, "a" or "an" may mean one or more. As used herein in the claim(s), when used in conjunction with the word "comprising", the words "a" or "an" may mean one or more than one.

As used herein "another" or "other" may mean at least a second or more of the same or different claim element or components thereof. Similarly, the word "or" is intended to include "and" unless the context clearly indicates otherwise. "Comprise" means "include."

As used herein, the term "about" refers to a numeric value, including, for example, whole numbers, fractions, and percentages, whether or not explicitly indicated. The term "about" generally refers to a range of numerical values (e.g., ±5-10% of the recited value) that one of ordinary skill in the art would consider equivalent to the recited value (e.g., having the same function or result). In some instances, the term "about" may include numerical values that are rounded to the nearest significant figure.

As used herein, the term proximal refers to the open end of the case portion of the miswak case and the term distal refers to portions and/or components of the miswak case and cap away from the open end.

As used herein, the terms "case" and "case portion" and the terms "cap" and "cap portion" are used interchangeably, respectively.

In one embodiment of the present invention, there is provided a multifunctional case for storing, cutting and peeling miswak, comprising a case portion; and a cap portion in a removable covering relation with the case portion.

Further to this embodiment the multifunctional case may comprise means for connecting said cap portion to the case portion. Representative connecting means may be a twist-off mechanism, a flip-top, a hinge, a lip and bump mechanism, or a combination thereof. In another further embodiment the multifunctional case may comprise means for advancing and retracting a miswak twig contained in the case portion. Representative advancing and retracting means may be a twist-up mechanism or a slide mechanism.

In another further embodiment the case portion may comprise a clipper disposed therein. The clipper may comprise a pair of clipping arms each having a clipping edge on proximal ends thereof, said clipping edges disposed at an open face on a proximal end of the case portion and said clipping arms joined at distal ends thereof and affixed to a distal end of the case portion; a lever arm disposed on the proximal end of the clipping arm through an opening formed proximal to the open face, said lever arm extending longitudinally along an outer surface of the case portion; a pin in a connecting relationship to the clipping arms and the lever arm; and means for affixing or removably securing the clipper within the case portion. In an aspect of this further embodiment, the clipper may be removably secured, where the opening through which the lever arm is disposed comprises a slot connecting to the open face of the case portion.

In yet another further embodiment, the cap portion may comprise a peeler disposed therein. The peeler may comprise a body having a hollow, conical cavity formed therein that comprises an open face on a proximal end and a tapered end on a distal end of the body; and an open slot formed from the proximal end to the distal end of the cavity in open connection with the open face; a blade disposed proximal to and parallel to the open slot; and means for securing to the cap portion.

In yet another further embodiment, the cap portion may comprise a cluster of bristling picks affixed to an interior surface of the cap portion, where the bristling picks each comprise a base end affixed to the interior surface and a tapered, pointed end depending downwardly, equidistantly therefrom. The tapered, pointed ends of the bristling picks may have a diameter across the cluster of about 1 centimeter.

In all embodiments the case portion and the cap portion each may comprise one or more compartments, each of the compartments having an open face on proximal ends thereof and wherein the case portion open face(s) are coincident with the cap portion open face(s) when the cap portion covers the case portion.

In one aspect of all embodiments the case portion may comprise one compartment configured to contain at least one miswak twig therein and the cap portion may comprise the one or more compartments with a peeler disposed in one compartment or a cluster of bristling picks disposed in another compartment or a combination thereof.

In another aspect the case portion may comprise more than one compartment with a first of the compartments configured to contain a miswak twig and a second of the compartments comprising a clipper disposed therein and the cap portion may comprise the one or more compartments with a peeler disposed in one compartment or a cluster of bristling picks disposed in another compartment or a combination thereof.

In yet another aspect the case portion may comprise the one or more compartments with a clipper disposed in one of the compartments and the cap portion comprises the one or more compartments with a first of the compartments comprising a storage compartment and a second of the compartments comprising a peeler compartment with a peeler disposed therein.

In yet another aspect the case portion may comprise more than one compartment with a first of the compartments configured to contain a miswak twig and a second of the compartments comprising a clipper disposed therein and the cap portion comprises more than one compartment, said compartments individually comprising a storage container and/or a plurality of bristling picks affixed therein and a peeler disposed therein.

In all embodiments and aspects thereof the case portion and the cap portion independently may comprise brushed aluminum, carved wood, polypropylene, tritan, silicone, rubber, glass, or a combination thereof.

In another embodiment of the present invention there is provided a device for storing, cutting and peeling miswak, comprising a case with a first compartment and a second compartment; a clipper removably secured within the second compartment; a cap with a forward compartment and a back compartment and having means for connecting to the case, said cap removably covering the case; and a peeler removably secured within the back compartment of the cap. Further to this embodiment the device may comprise a twist-up mechanism or a slide mechanism disposed on the case and configured for advancing and retracting a miswak twig disposed within the first compartment thereof.

In both embodiments the first compartment and the second compartment of the case and the front compartment and the back compartment of the cap each may have an open face on proximal ends thereof and wherein the case open faces are coincident with the cap open faces when the cap covers the case.

In an aspect of both embodiments clipper may comprises a pair of clipping arms each having a clipping edge on proximal ends thereof, where the clipping edges are disposed at the first compartment open face of the case and the clipping arms are joined at distal ends thereof and affixed to a distal end of the case; a lever arm disposed on the proximal end of the clipping arm through a slot connecting to the first compartment open face such that the lever arm extends longitudinally along an outer surface of the case; a pin in a connecting relationship to the clipping arms and the lever arm; and means for removably securing the clipper within the case portion.

In another aspect the peeler may comprise a body having a hollow, conical cavity formed therein that comprises an open face on a proximal end and a tapered end on a distal end of the body; and an open slot formed from the proximal end to the distal end of the cavity in open connection with the open face; a blade disposed proximal to and parallel to the open slot; and means for securing to the cap.

Also in both embodiments and aspects thereof, the front compartment in the cap may be a storage compartment. In addition the case and the cap independently comprise brushed aluminum, carved wood, polypropylene, tritan, silicone, rubber, glass, or a combination thereof.

In yet another embodiment of the present invention, there is provided a kit for storing, cutting and peeling a miswak twig, comprising the multifunctional case as described supra and one or more miswak twigs stored within the multifunctional case.

Provided herein are multifunctional devices, cases and kits for storing, cutting and peeling a miswak twig. Miswak is used as an alternative to a toothbrush with the bristles at one end thereof functioning as the "brush". When a section of bristles are used, they are removed from the twig to promote hygiene. The same end of the twig is then peeled to remove the bark and to expose another section of the miswak that can then be bristled for the next use. Thus, generally, the kit comprises a case for storing the miswak, a clipper for cutting the miswak and a peeler for peeling the miswak. Materials for the case and the cap may be, but are not limited to brushed aluminum, carved wood, polypropylene, polypropylene, tritan, silicone, rubber, glass, or a combination thereof. The case and cap may be decorative.

More particularly the case comprises a case portion and a cap portion. The case portion may comprise a single compartment for storage of the miswak only or the case portion may be compartmentalized with two or more compartments to separate the miswak twig stored within from the clipper. The miswak twig is stored within the first compartment. The case or case portion comprises a plurality of openings formed through the outer surface of the case bounding the first compartment for air circulation.

The dimensions of the first compartment are such that the inner walls thereof comprise a grip for the miswak twig requiring that a user pull the twig out of the first compartment or may be wide enough for the miswak twig to advance or retract when moved via a mechanism or means disposed on the case or to slide out when the case is tilted. For example, a twist-up mechanism may be disposed at the bottom of the first compartment of the case portion so that a user can push or advance a desired portion of the miswak twig out of the case portion by twisting the mechanism. Alternatively, the case or case portion may comprise a slide mechanism disposed on the case or case portion to advance or retract the miswak as the slide is moved forwards or backwards. The slide may be moved in a continuous motion or may be advanced step-wise.

The clipper may be stored in a second compartment comprising the case portion. The clipper comprises a compound lever, as is known in the art, with a pair of sharp-ended, mandible-like clipping arms and a lever arm rotatable around a pin that connects the clipping arms to enable movement of the clipping arms in a clipping or cutting motion. The distal end of the clipping arms at the adjoinment or fulcrum are affixed within the case portion at least at the distal end thereof, and preferably at the distal and proximal ends. For example, the clipper may be affixed with one or more rivets or screws. The number of fastenings may be increased as deemed necessary. The lever arm extends through an opening, slot or cutout on the case portion or case and, when not in use, extends along the longitudinal axis of the case. Alternatively, the clipper may be a pair of scissors configured to cut used bristles or sections of a miswak twig. The lever arm, when not in use, also is a clip and can be utilized as a means for clipping the multifunctional case onto a user's clothing, for example, a belt or pocket, or any other convenient location for the user. Optionally, the clipper may be removable from the case. In a non-limiting example, the clipper is fastened within the case portion via one or more removable screws through the case and the lever arm is received along an open-ended slot or cutout on the proximal edge of the case portion. After removing the screws the clipper may be slid out of the case portion.

The cap portion or cap of the case contains the peeler. The cap is removably secured to the case portion whereby the cap and the case portion together comprise a latch mechanism or means for removably connecting the cap with the case portion. For example, the connecting means may be, but not limited to, a flip top, a bump and lip mechanism, a hinge, or a combination thereof.

The cap may comprise one or more compartments. In a compartmentalized cap, one or more cap compartments may comprise one or more storage areas. In a non-limiting example, a front compartment(s) is configured to receive a storage container(s) therein. A storage container may be removably secured to the interior of the cap compartment into which it is inserted. For example, the storage container may comprise a female engagement means corresponding to a male engagement means disposed on an interior surface of the front compartment into which it is secured, such as, but not limited to, a snap-like mechanism or a plurality of openings receiving a plurality of tabs or a lip and bump mechanism. The storage container is snapped, pushed, or bumped onto the snap studs or tabs to secure it to the cap and unsnapped, pulled, or bumped off the cap for removal. Alternatively, the storage container may be secured with a screw through the cap surface correspondingly to the removable clipper in the case. This enables the storage container to be removed for refilling or emptying. The storage container may be used to store, for example, but not limited to, the peel from the miswak twig removed by the peeler, scented oil, fragrances, fresh mint, cumin seeds, or other items.

A front compartment may contain a plurality of tapered picks extending downwardly from an inner surface of the front compartment. The picks are grouped or clustered such that a diameter across the collective group may be about 1 centimeter. A non-limiting number of picks is about seven. The pointed ends of the picks are equidistant from the open face of the compartment that is exposed when the cap or cap portion is not positioned on the case or case portion. This enables a peeled miswak twig to be inserted into the compartment and bristled to render it more toothbrush-like by twisting the peeled end of the miswak against the pointed ends of the picks. The pressure exerted by the plurality of pointed pick ends better distributes the force on the Miswak bristles so formed and enables them to separate without being damaged. The fewer picks used, the more coring-like the force exerted against the peeled miswak becomes.

The picks may comprise a means for removably securing a storage container within a compartment of the cap or cap portion of the multifunctional device. The bases of the picks are securely affixed to the compartment inner surface in the cap or cap portion. One or more of the picks may comprise a mechanism by which a storage container is removably secured within the compartment. A non-limiting example is a lip and bump mechanism disposed at the base of the pick(s) where an outer surface of the storage container is configured to engage with the mechanism at the bases.

A back cap compartment contains the peeler. The peeler may be a device configured to peel the outer layer or bark from the miswak twig to expose an unused end with which to safely clean the teeth. The removed peel is easily extracted from the cap or may remain in the back compartment for removal at a later time. Alternatively, the peeler may be substantially equivalent to a wire stripper.

The peeler may be affixed within or removably secured within the cap with a fastening mechanism comprising female and male components. In a non-limiting example, the peeler may comprise a plurality of openings on the back side thereof and the cap may comprise an equivalent plurality of tabs or snap-like components on the inner surface of the back side of the cap. The peeler is pushed, snapped or bumped onto the tabs to secure it to the cap and pulled, unsnapped or bumped off the cap for removal. Alternatively, the peeler may be secured with a screw through the cap surface correspondingly to the removable clipper in the case. This enables the peeler to be removed for cleaning if necessary.

The peeler has a body with a conical shaped or tapering opening formed longitudinally therethrough such that the interior of the holder is a hollow cone with an open front face and a tapered end. The inner surface of the hollow cone comprises an open slot formed from the front face to the tapered end. A blade is affixed along the length of the conical opening proximate to and parallel with the open slot. As the blade peels the miswak bark from the twig, the peeling enters the open slot and is easily removable through the open front face of the peeler.

The dimensions of the case and portions, compartments and components thereof may be any length and width to accommodate a variety of miswak twig sizes or, when the case is used only for storage, a plurality of miswak twigs. The length may be longer to easily fit larger hands for ease of accessibility to miswak twig or shorter for ease of use by a child. The width of the cap corresponds to that of the case, however, although the length of the case is variable, the length of the cap is unchanged. A shorter length improves portability and enables a user to carry the miswak on his person. Generally, the length of the case and cap is about 13 cm to about 16 cm. In non-limiting representative examples, a device for only storing and peeling the miswak or further comprising the clipper may be about 15 to about 16 cm or a device further comprising a means for advancing or retracting the miswak twig may be about 13 cm to about 14 cm.

Also provided herein are kits comprising the device and one or more miswak twigs stored therein. The kits may comprise the case containing one or more miswak twigs and the cap. Alternatively, the kit may comprise the compartmented case with miswak twig and clipper and the cap containing the peeler with or without compartments. The kits may be produced with devices of different lengths and may contain miswak twigs of the same or different lengths.

Particularly, embodiments of the present invention are better illustrated with reference to the Figure(s), however, such reference is not meant to limit the present invention in any fashion. The embodiments and variations described in detail herein are to be interpreted by the appended claims and equivalents thereof.

Figure 1B:
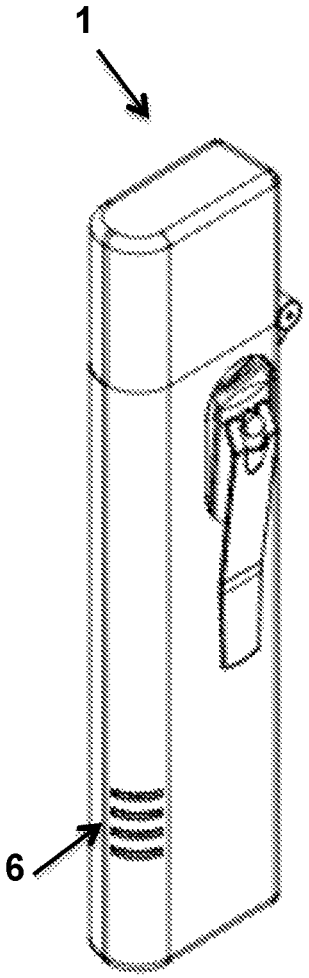

FIGS. 1A-1B illustrate the multifunctional miswak device 1. FIG. 1A is a side and back view of the device. The device 1 comprises a case or case portion 2 and a cap or cap portion 3. The cap is movably affixed to the case with a hinge 4. The case comprises an opening 5 (see FIG. 3) through which the lever arm 23 of the clipper 20 (see FIG. 2). FIG. 1B is a side and front view depicting a plurality of openings or slots 6 through to the interior of the case for air circulation.

Figure 2:
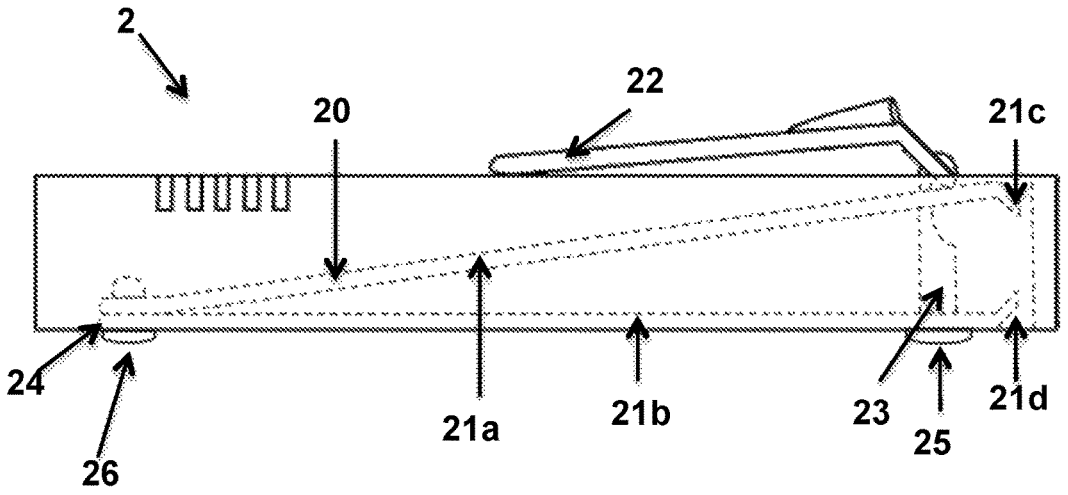
FIG. 2 is a cross-sectional view of the miswak case illustrating the placement of the clipper therein.

FIG. 2 illustrates the components and placement of the clipper 20 in the case portion 2. The clipper 20 is disposed within the case portion and comprises a pair of clipping arms 21*a,b* each comprising a sharpened clipping end 21*c,d*, a lever arm 22 and a pin 23 around which the lever arm rotates. The lever arm extends through the opening 5 (see FIG. 3) and lies along the outer surface of the case portion. The clipper is positioned so that the pair of clipping arms are disposed at the open face 32*a* of the case portion (see FIG. 3) whereby, when the open face of the case portion is uncovered, a miswak twig is easily insertable between the clipping arms. The diameter between the clipping arms is at least 1 centimeter to accommodate varying sizes of miswak twigs. The clipper is affixed to or removably secured to the case portion at the pin 23 and at the fulcrum 24 of the clipper with fastenings through securement openings at 25, 26, respectively.

Figure 3:
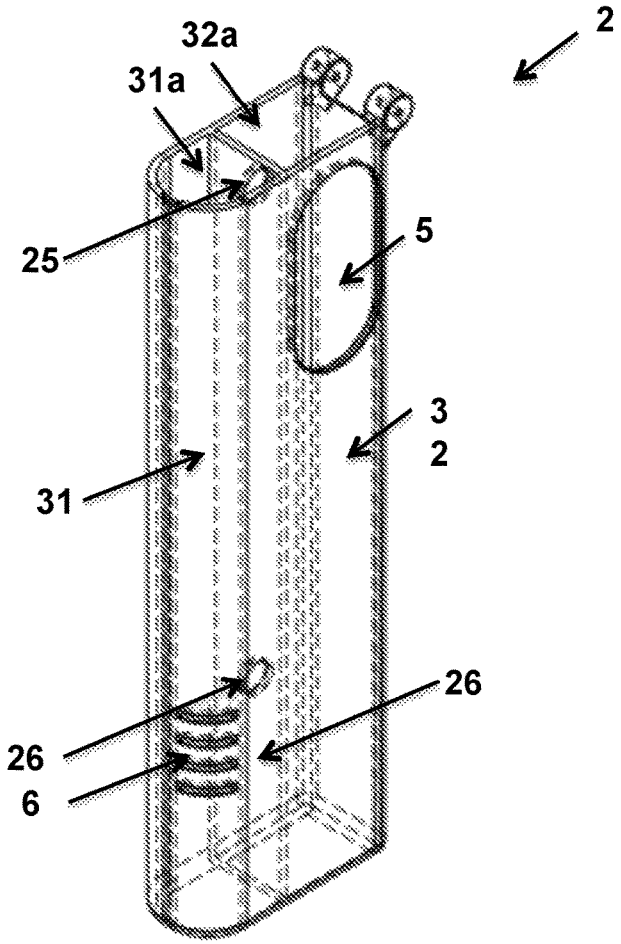
FIG. 3 is a perspective front and side view of the case or case portion showing the compartmentalized interior.

FIG. 3 illustrates compartmentalization of the case or case portion. The case portion 2 comprises a first compartment 31 configured to contain a miswak twig and a second compartment 32 configured to contain the clipper 20. The first and second compartments are delineated by the common wall or divider 33. The first compartment has a first open face 31*a* and the second compartment has a second open face 32*a*. The first open face 31*a* enables insertion or removal of the miswak twig from the case and the second open face 32*a* enables insertion of the miswak twig between the clipping ends 21*c,d* for clipping off the used bristled end of the miswak. The lever arm opening 5 is disposed on the second compartment proximate to the second open face. In a configuration where the clipper is removable from the second compartment, the lever arm opening would form a slot with or open onto the second open face 32*a*. The plurality of air openings or slots 6 open into the first compartment. The dimensions of each of the air openings is about 0.5 cm in length by about 0.2 cm in width. The positioning of the securement openings 25, 26 at the proximal and distal ends of the second compartment are illustrated (see FIG. 2).

Figure 4:
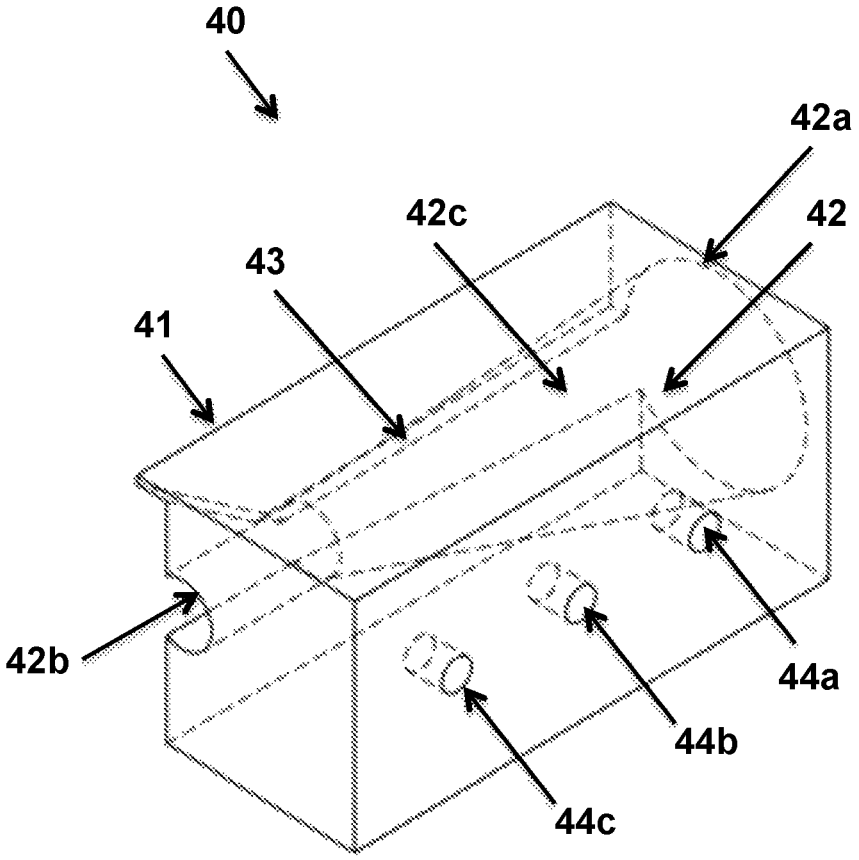
FIG. 4 illustrates the components of the peeler.

FIG. 4 illustrates the peeler showing the interior configuration. The peeler 40 comprises a body 41 with a hollow conical interior 42 or cavity formed therein that has an open face 42*a*, a tapered end 42*b* and an open slot 42*c* formed along the length of the conical interior. The open face 42*a* may have a diameter of about 0.8 centimeters to about 1.6 centimeters and the tapered end 42*b* may have a diameter of 0.3 centimeters to about 0.6 centimeters. A blade 43 is disposed proximate to the open slot and parallel thereto. The peeler comprises a plurality of openings or female engagement means 44*a,b,c* configured to removably, interlockingly receive a corresponding plurality of tabs, snap-like studs or male engagement means.

Figure 5:
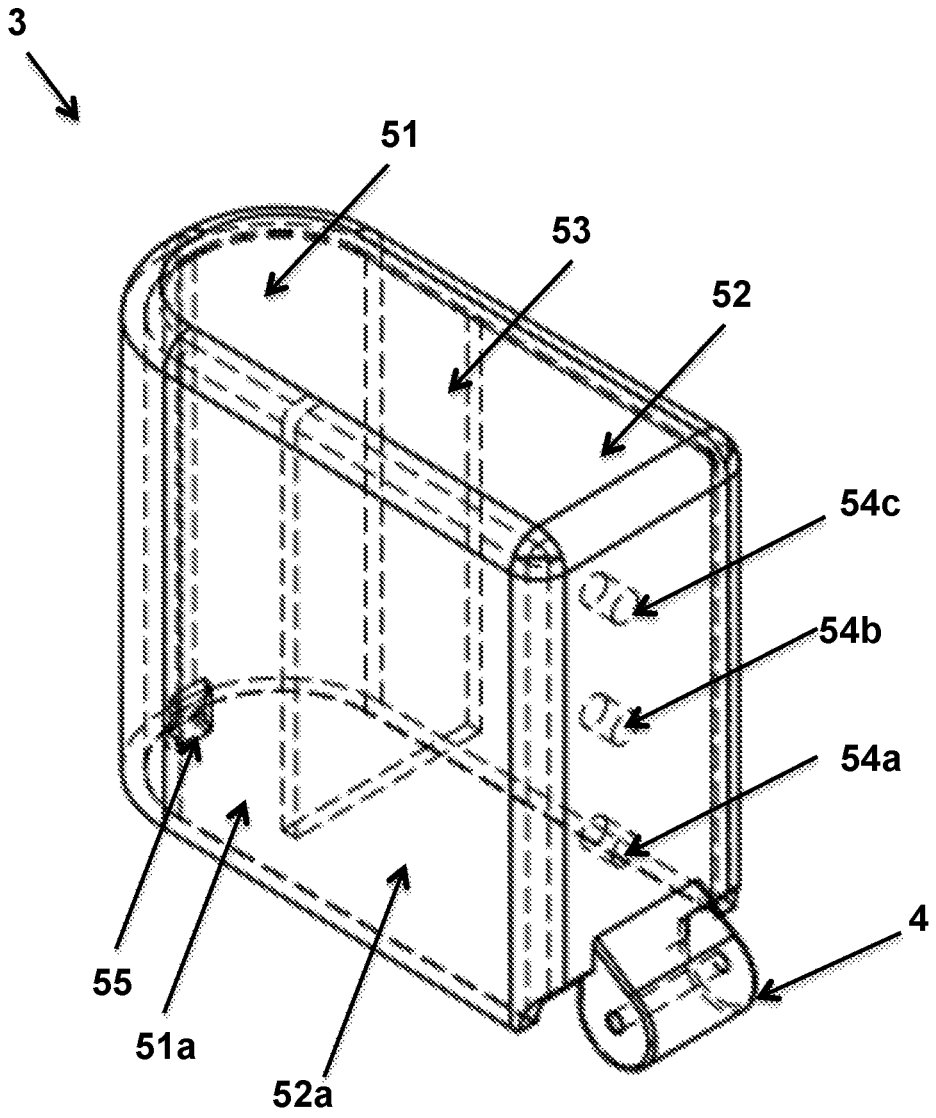
FIG. 5 is a perspective top and side view of the cap or cap portion showing the compartmentalized interior.

FIG. 5. illustrates compartmentalization of the cap or cap portion. The cap or cap portion 3 comprises a front storage compartment 51 to contain a storage container and a rear peeler compartment 52 to contain the peeler 40. The storage compartment and the peeler compartment are delineated by the common wall or divider 53. The storage compartment and the peeler compartment each have an open face 51*a*,

52*a*, respectively, that are accessible when the cap is opened or removed from the case portion 2. The back surface of the cap comprises a plurality of tabs, snap-like studs or male engagement means 54*a,b,c* configured to removably, interlockingly engage with a corresponding plurality of plurality of openings or female engagement means 44*a,b,c* on the peeler 40 (see FIG. 4). Opposite to the hinge 4, the front proximal edge of the cap comprises a latch 55 or other fastener or fastening means which enables the cap or cap portion to be opened or secured closed when the cap is pivoted upwardly or downwardly around the hinge.

Figure 6:
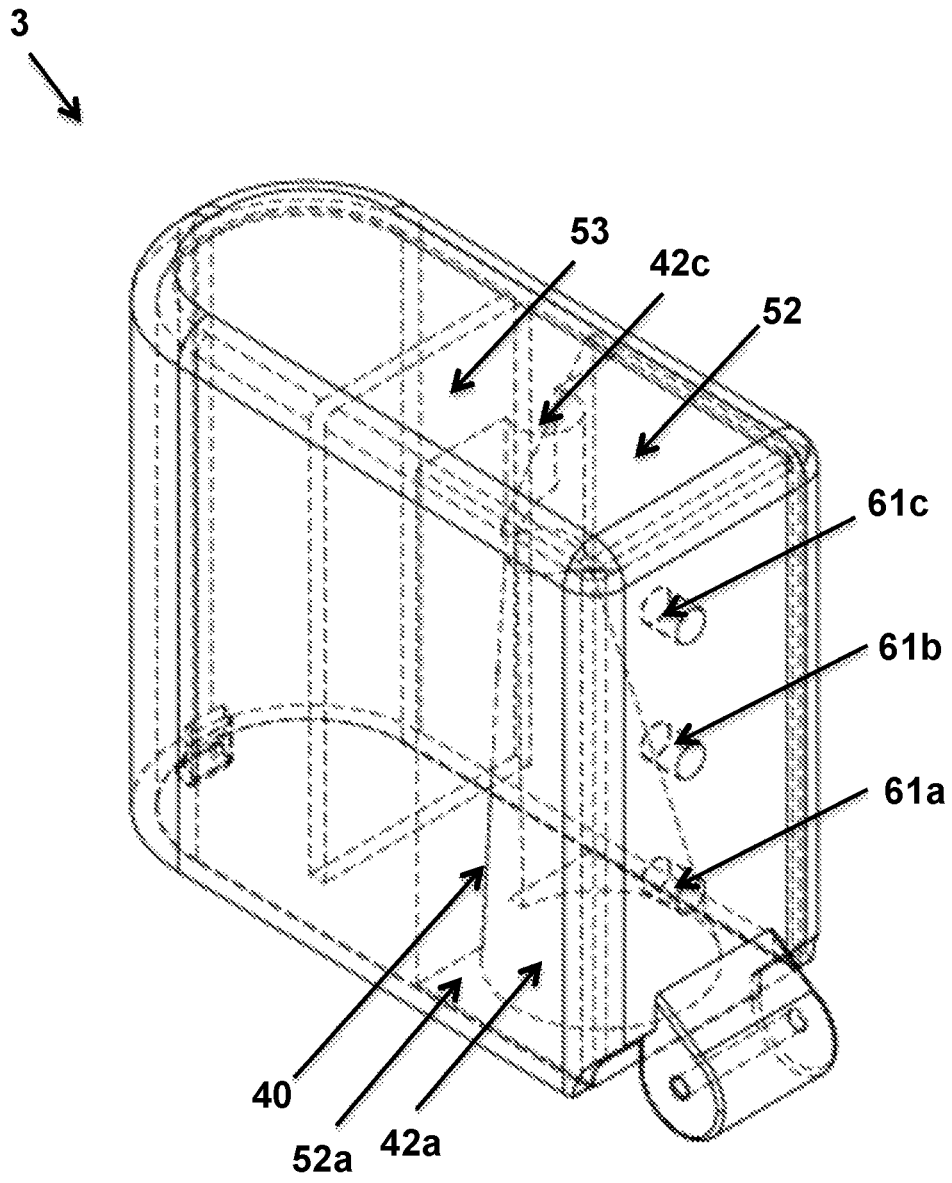
FIG. 6 illustrates the general placement of the peeler within the compartmentalized cap.
Figure 7:
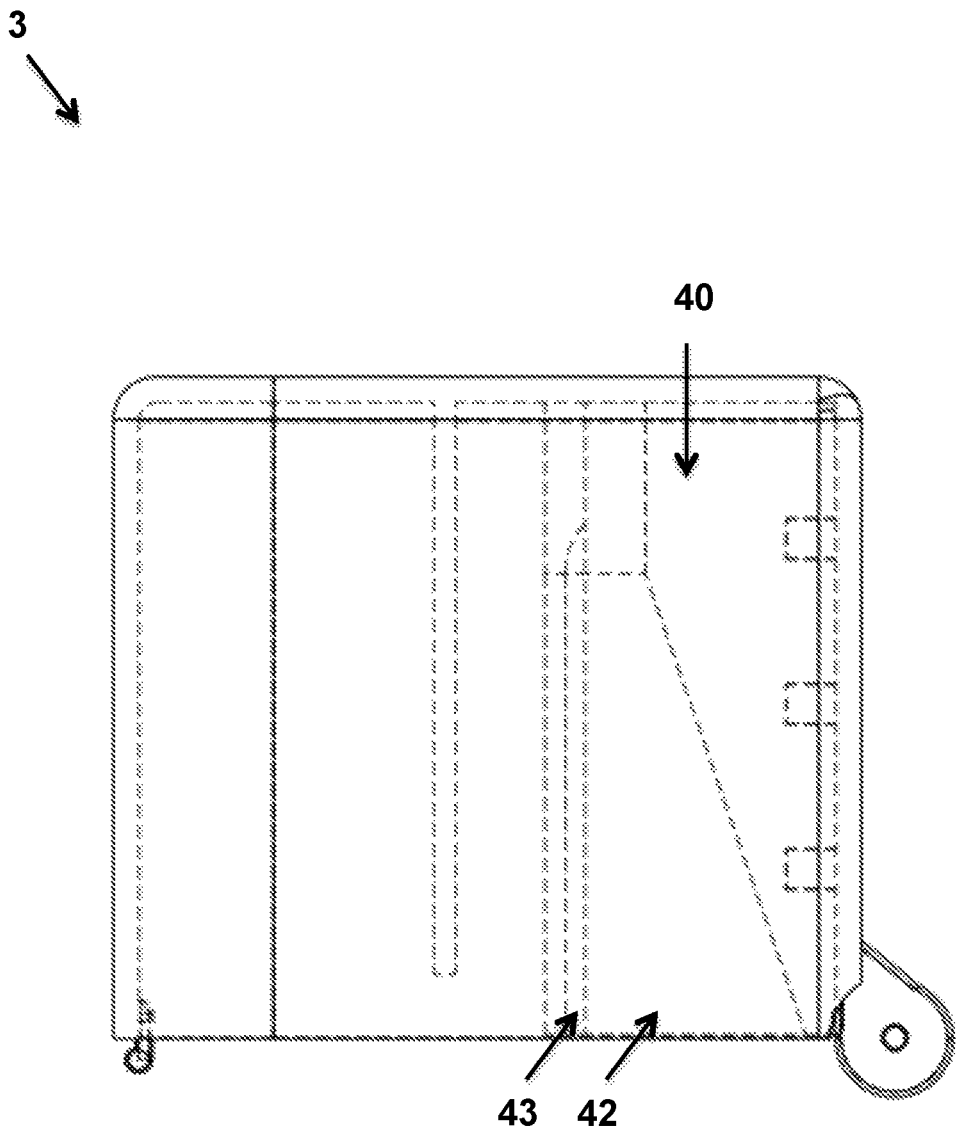
FIG. 7 is a cross-sectional view of FIG. 6.

FIG. 6 illustrates the placement of the peeler 40 in the cap portion 3. The peeler is disposed within the peeler compartment 52 so that the peeler open face 42*a* is coincident with the peeler compartment open face 52*a* and the peeler interior open slot 42*c* opens toward the common divider 53 in the cap portion. The peeler is removably secured to the cap portion at 61*a,b,c* whereby the male engagement means 54*a,b,c* have engaged the female engagement means 44*a,b,c* disposed on the peeler (see FIGS. 4-5). With continued reference to FIG. 6, FIG. 7 is a cross-sectional view of the compartmentalized cap 3 with peeler 40. The placement of the blade 43 proximate to the hollow, concave interior 42 of the peeler is illustrated.

Figure 8:
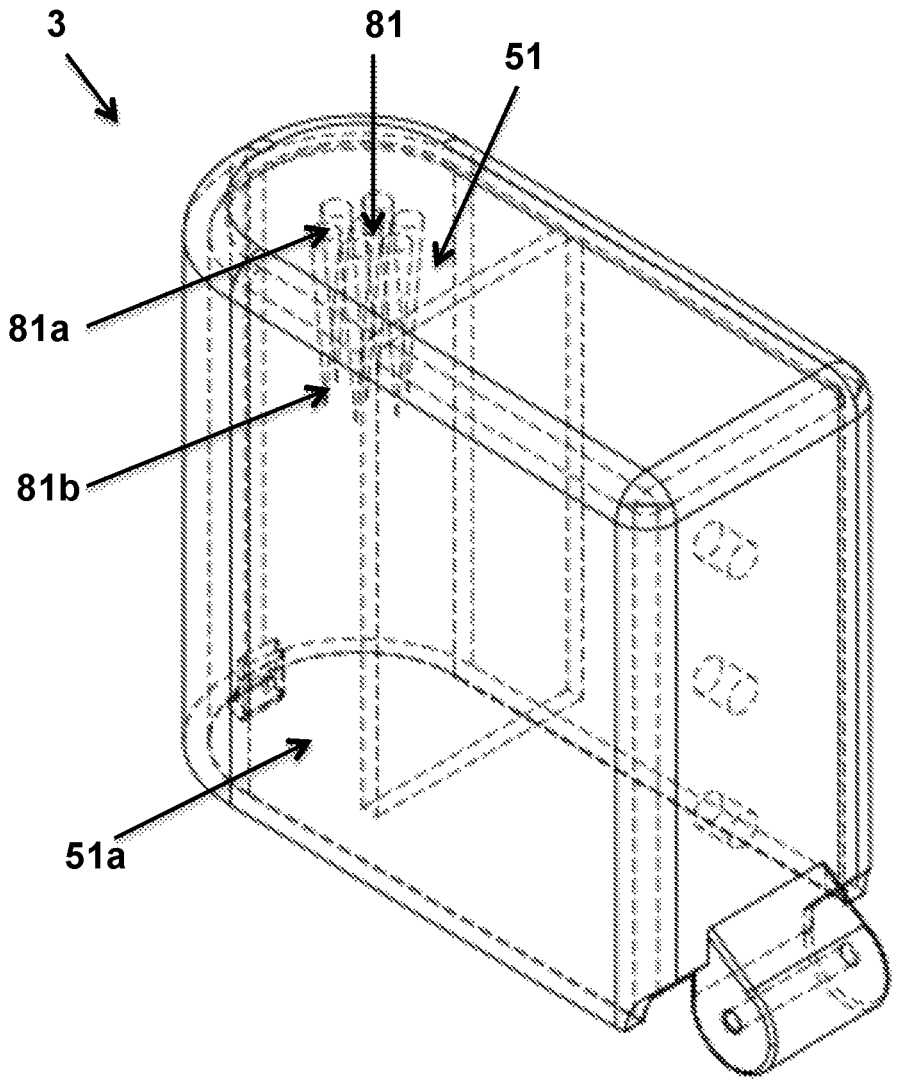
FIG. 8 is a perspective top and side view of the cap or cap portion showing the compartmentalized interior with the component for bristling the miswak.

With continued reference to FIG. 5, FIG. 8 illustrates a variation of the cap or cap portion 3. The front compartment comprises a component for bristling a miswak twig. A plurality of seven downwardly tapering picks 81 are affixed to an inner surface of the front compartment 51. Each of the picks has a base end, as represented by 81*a*, and a pointed end or pressure point, as represented by 81*b* and extends downwardly such that a plane 82 (see FIG. 10) containing the pointed ends of the picks is parallel to the open face 51*a* of the front compartment.

Figure 9:
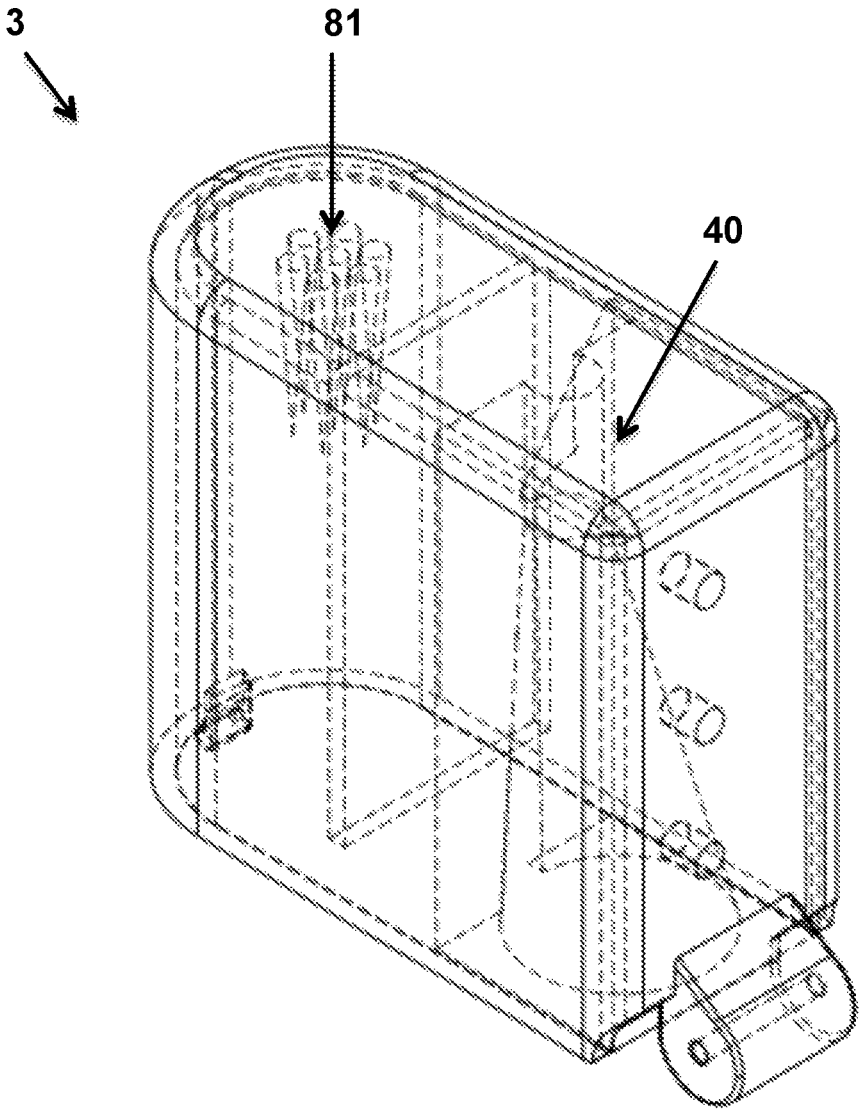
FIG. 9 illustrates the general placement of the peeler within the compartmentalized cap in relation to the bristling component.

With continued reference to FIG. 8, FIG. 9 illustrates the placement and engagement of the peeler 40 within the cap portion 3 in relation to the plurality of picks 81.

Figure 10:
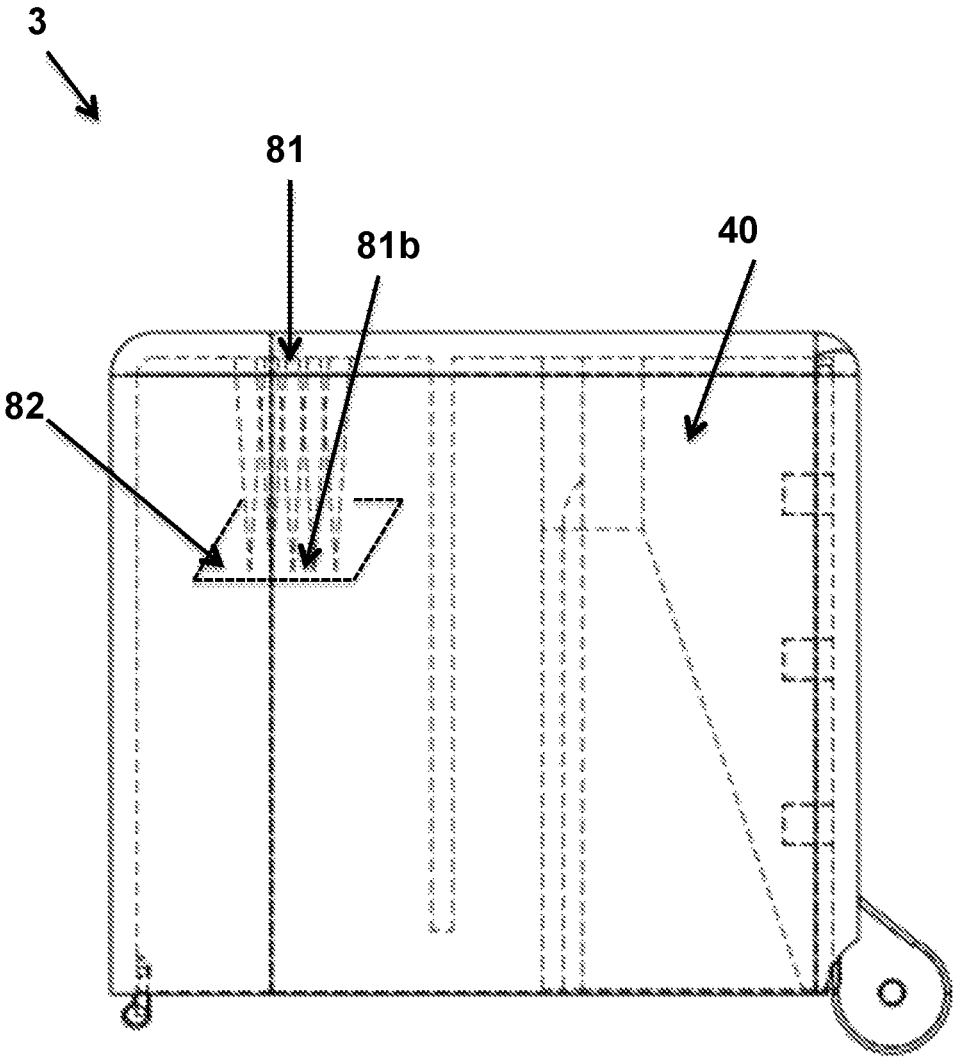
FIG. 10 is a cross-sectional view of FIG. 9.

With continued reference to FIG. 9, FIG. 10 is a cross-sectional view of the compartmentalized cap 3 with the picks 81 and the peeler 40. The pointed ends 81*b* of the picks 81 each depend to provide a planar surface 82 against which a peeled miswak twig is bristled.

The present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention.

What is claimed is:

1. A multifunctional case for storing, cutting and peeling miswak, comprising:

a case portion;

a clipper disposed within the case portion comprising:

a pair of clipping arms each having a clipping end disposed at the first compartment open face of the case and a fulcrum end joined together and affixed to the case;

a lever arm disposed at the clipping end of the clipping arm through a slot connecting to the first compartment open face and extending longitudinally along an outer surface of the case;

a pin in a connecting relationship to the clipping arms and the lever arm; and;

means for affixing or removably securing the clipper within the case portion;

a cap portion in a removable covering relation with the case portion;

a peeler disposed within the cap portion comprising:

a body having a hollow, conical cavity formed therein comprising an open front face and a tapered end and an open slot formed from the open front face to the tapered end in open connection with the open front face;

a blade disposed proximal to and parallel to the open slot; and means for securing the peeler to the cap portion; and a cluster of bristling picks, each comprising a base end affixed to the interior surface and a tapered, pointed end depending downwardly, equidistantly therefrom, affixed to an interior surface of the cap portion.

2. The multifunctional case of claim 1, further comprising means for connecting said cap portion to the case portion.

3. The multifunctional case of claim 2, wherein the connecting means comprises a twist-off mechanism, a flip-top, a hinge, a lip and bump mechanism, or a combination thereof.

4. The multifunctional case of claim 1, further comprising means for advancing and retracting a miswak twig contained in the case portion.

5. The multifunctional case of claim 4, wherein the advancing and retracting means comprises a twist-up mechanism or a slide mechanism.

6. The multifunctional case of claim 1, wherein said clipper is removably secured, said opening through which the lever arm is disposed comprises a slot connecting to the open face of the case portion.

7. The multifunctional case of claim 1, wherein the tapered, pointed ends of the bristling picks have a diameter across the cluster of about 1 centimeter.

8. The multifunctional case of claim 1, wherein the case portion and the cap portion each comprise one or more compartments, each of the one or more compartments having an open face and wherein the one or more case portion compartment open faces are coincident with the one or more cap portion compartment open faces when the cap portion covers the case portion.

9. The multifunctional case of claim 8, wherein the case portion comprises one compartment configured to contain at least one miswak twig therein and the cap portion comprises the one or more compartments with a peeler disposed in one compartment or a cluster of bristling picks disposed in another compartment or a combination thereof.

10. The multifunctional case of claim 8, wherein the case portion comprises more than one compartment with a first of the compartments configured to contain a miswak twig and a second of the compartments comprising a clipper disposed therein and the cap portion comprises the one or more compartments with a peeler disposed in one compartment or a cluster of bristling picks disposed in another compartment or a combination thereof.

11. The multifunctional case of claim 8, wherein the case portion comprises the one or more compartments with a clipper disposed in one of the compartments and the cap portion comprises the one or more compartments with a first of the compartments comprising a storage compartment and a second of the compartments comprising a peeler compartment with a peeler disposed therein.

12. The multifunctional case of claim 8, wherein the case portion comprises more than one compartment with a first of the compartments configured to contain a miswak twig and a second of the compartments comprising a clipper disposed therein and the cap portion comprises more than one compartment, said compartments individually comprising at least one of a storage container and a plurality of bristling picks affixed therein and a peeler disposed therein.

13. The multifunctional case of claim 1, wherein the case portion and the cap portion independently comprise brushed aluminum, carved wood, polypropylene, tritan, silicone, rubber, glass, or a combination thereof.

14. A kit for storing, cutting and peeling a miswak twig, comprising:

the multifunctional case of claim 1; and one or more miswak twigs stored within the multifunctional case.

15. A multifunctional device for storing, cutting and peeling miswak, comprising:

a case with a first compartment and a second compartment;

a clipper removably secured within the second compartment;

a cap with a front compartment, a back cap compartment and means for connecting to the case, said cap removably covering the case; and a peeler removably secured within the back cap compartment.

16. The multifunctional device of claim 15, further comprising a twist-up mechanism or a slide mechanism disposed on the case and configured for advancing and retracting a miswak twig disposed within the first compartment thereof.

17. The multifunctional device of claim 15, wherein the first compartment and the second compartment of the case and the front compartment and the back compartment of the cap each have an open face and wherein said case open faces are coincident with said cap open faces when the cap covers the case.

18. The multifunctional device of claim 17, wherein the clipper comprises:

a pair of clipping arms each having a clipping end disposed at the first compartment open face of the case and a fulcrum end joined together and affixed to the case;

a lever arm disposed at the clipping end of the clipping arm through a slot connecting to the first compartment open face and extending longitudinally along an outer surface of the case;

a pin in a connecting relationship to the clipping arms and the lever arm; and means for removably securing the clipper within the case portion.

19. The multifunctional device of claim 18, wherein said peeler comprises:

a body having a hollow, conical cavity formed therein comprising:

an open face on a proximal end and a tapered end on a distal end of the body; and an open slot formed from the proximal end to the distal end of the cavity in open connection with the open face;

a blade disposed proximal to and parallel to the open slot; and means for securing the peeler to the cap.

20. The malfunctional device of claim 15, wherein the connecting means comprises a twist-off mechanism, a flip-top, a hinge, a lip and bump mechanism, or a combination thereof.

21. The multifunctional device of claim 15, wherein the front compartment of the cap is a storage compartment.

22. The multifunctional device of claim 15, wherein the case and the cap independently comprise brushed aluminum, carved wood, polypropylene, tritan, silicone, rubber, glass, or a combination thereof.

* * * * *